United States Patent [19]

Olesen

[11] Patent Number: 4,720,033

[45] Date of Patent: Jan. 19, 1988

[54] MOTOR-OPERATED FASTENER DRIVING MACHINE WITH MOVABLE ANVIL

[75] Inventor: Paul Olesen, Bellmore, N.Y.

[73] Assignee: Swingline Inc., Long Island, N.Y.

[21] Appl. No.: 903,170

[22] Filed: Sep. 3, 1986

Related U.S. Application Data

[63] Continuation-in-part of Ser. No. 859,545, May 5, 1986, abandoned.

[51] Int. Cl.[4] ..... B25C 1/06; B27F 7/36; B27F 7/19; B27F 7/21

[52] U.S. Cl. ..... 227/131; 227/129; 227/142; 227/155

[58] Field of Search ..... 227/7, 120, 131, 155, 227/156, 142, 129

[56] References Cited

U.S. PATENT DOCUMENTS

| | | | |
|---|---|---|---|
| 945,769 | 1/1910 | Elliott | 227/142 |
| 2,252,886 | 8/1941 | Fusco | 227/131 X |
| 2,500,217 | 3/1950 | Taylor, Jr. | 227/131 X |
| 2,650,360 | 9/1953 | Nardone | 227/131 X |
| 2,770,805 | 11/1956 | Elzer et al. | 227/131 X |
| 4,199,095 | 4/1980 | Yomanoi | 227/120 X |
| 4,530,454 | 7/1985 | Gloor et al. | 227/131 X |
| 4,542,844 | 9/1985 | Olesen et al. | 227/7 |
| 4,572,419 | 2/1986 | Klaus et al. | 227/131 X |

FOREIGN PATENT DOCUMENTS

| | | | |
|---|---|---|---|
| 1952017 | 11/1971 | Fed. Rep. of Germany | 227/131 |

*Primary Examiner*—Paul A. Bell
*Attorney, Agent, or Firm*—Pennie & Edmonds

[57] ABSTRACT

A low-electric-current-demand stapler is disclosed. The stapler has a frame upon which is mounted a fastener driver mechanism including a fastener driving blade and drive unit, a blade drive-control unit including spaced-apart frame pieces mounted on the frame, a rotary driven wheel mounted on the drive-control unit, and an electric motor powered transmission apparatus for transmitting the rotary motion of the motor to the driven wheel.

10 Claims, 8 Drawing Figures

MOTOR-OPERATED FASTENER DRIVING MACHINE WITH MOVABLE ANVIL

RELATED APPLICATION

This application is a continuation-in-part application of U.S. Application Ser. No. 859,545 filed May 5, 1986 entitled "Motor-Operated Fastener Driving Machine", now abandoned.

BACKGROUND OF THE INVENTION

Numerous arrangements have been used and suggested for powering a stapler drive blade arrangement including electric solenoids and compressed air piston-cylinder units. Rotary motors have also been proposed including various means for converting the rotary motion into reciprocal movement to cause drive blades to drive fasteners (see U.S. Pat. Nos. 945,769; 2,252,886, 2,650,360; 2,770,805; and 4,199,095). It has also been suggested that portable tools include installed rotary power drives.

Power staplers for forming and driving staples from a belt supply of unformed staple blanks have been used for some years (U.S. Pat. No. 4,542,844). These staplers have been powered by hand or by solenoid units with attendant noise and, when solenoid operated, the requirement of high peak electrical current.

SUMMARY OF THE INVENTION

Broadly, the present invention comprises a low-electric- current-demand fastener driving device comprising a frame, a fastener driver mechanism including fastener driving blade and drive unit, a blade-drive-control unit for lowering and raising the blade-drive unit including spaced-apart drive-control unit frame pieces mounted on the frame, a rotary driven wheel on the drive-control unit, an electric-motor powered transmission arrangement for transmitting the rotary motion to the driven wheel.

The blade-drive-control unit in turn comprises a shaft axle driven by the driver wheel and extending through the frame pieces and having at least one cylindrical disc eccentricity mounted on the axle between the frame pieces. The cylindrical disc is engageable with a follower arm which arm is pivotally connected to the base and follows the cylindrical disc to cause the blade-drive-control unit to move back and forth in an arcuate path above the base. The arcuate motion of the blade-drive control unit causes the blade-drive unit to move arcuately (in upward and downward paths) to drive fasteners seriatim. Drive control unit may also be utilized to move the anvil to open and close positions.

It is a feature of the fastener machine that the electric motor transmission may be de-energized after each driving stroke by a suitable switching arrangement.

It is a further feature that the blade-drive unit includes a compressible spring positioned between the driving blade and the blade-drive control unit to accommodate for workpieces of differing thicknesses.

It is a further feature that follower arm members are placed internally of the drive-control unit for a more compact design and thus avoiding moment arm forces attendant with crank arms positioned at the ends of a crank shaft.

DESCRIPTION OF THE PREFERRED EMBODIMENT

Figure 1:
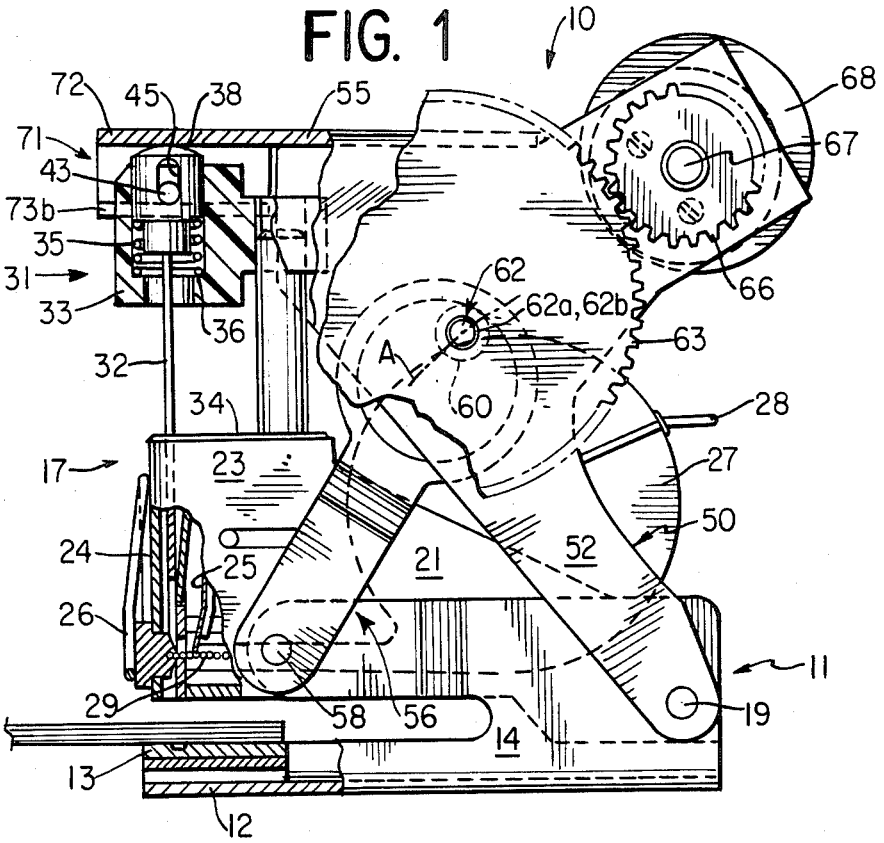
FIG. 1 is a right side elevational view of a motor-operated stapler machine in accordance with an embodiment of the invention with the staple drive-control unit including rotary drive unit in an upward position (portions cut- away)

Referring to FIGS. 1–5, stapler 10 has base 11 including base plate 12, anvil 13 and upright spaced-apart frame pieces 14, 16. Stapler mechanism 17 is pivotally carried on stapler frame arm pieces 21, 22 about pin axle 19. Stapler mechanism 17 also includes head section 23, stapler sheath 24, stapler head spring 26 for urging the head section 23 and sheath 24 together. Also shown are the stapler head cartridge 27; cartridge retaining spring 28; staple blank strip 29 fed from cartridge 27 by feed spring 25; upper driving unit 31 and head section plate 34.

Upper driving unit 31 includes staple drive blade 32; drive blade housing 33, head section plate 34, housing cavity 35, compensation spring 36 housed in cavity 35, and plunger button head 38. Blade housing 33 is movable up and down on upright post 41 which post 41 is mounted in head section 23 (see FIGS. 1 and 4). Housing 33 has extension **33*a* with hole 33*b* therein through which post 41 extends (see FIG. 2). Plunger button head 38 is urged upwardly by compensation spring 36 while being retained in housing cavity 35 by pin 43 in slot 45 of button head 38**.

Figure 2:
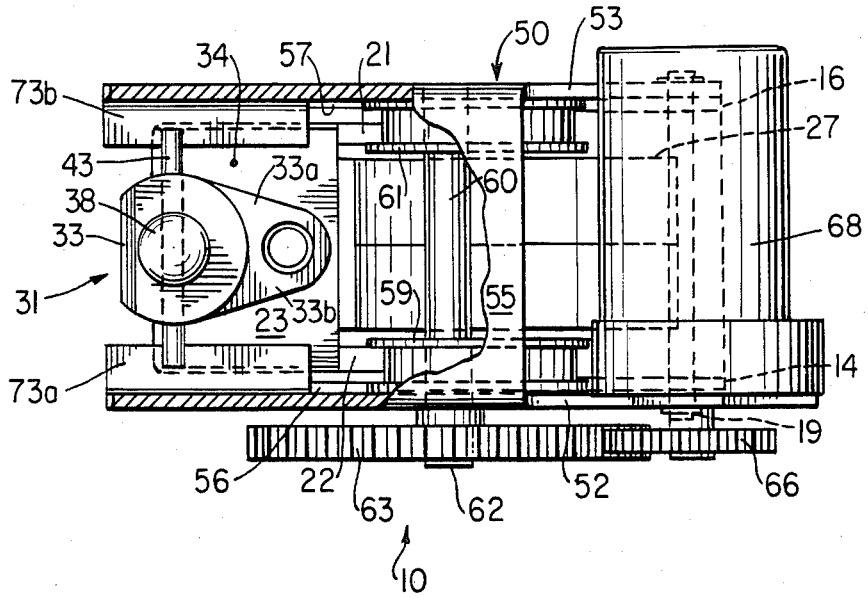
FIG. 2 is a top elevational view of the stapler machine (portions cut-away)
Figure 3:
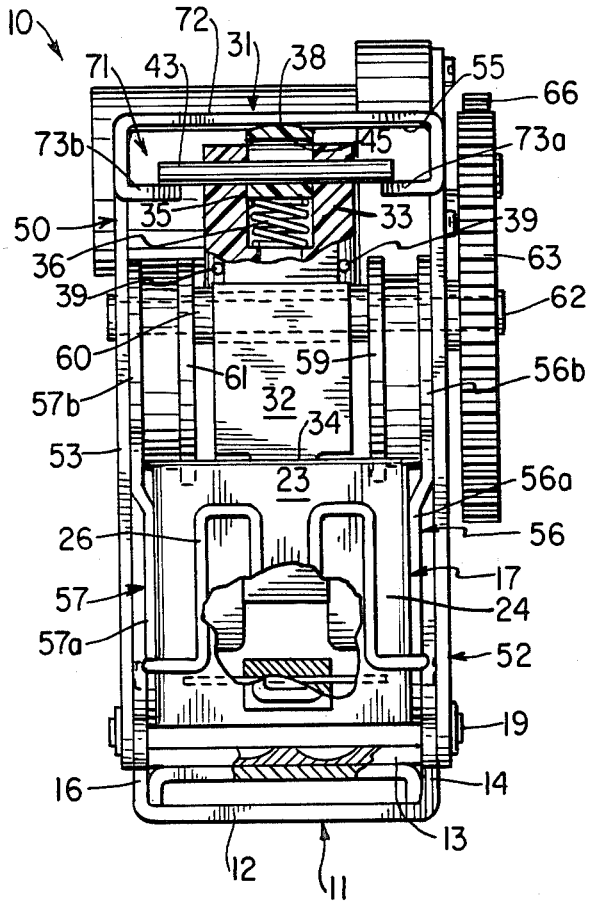
FIG. 3 is a front elevational view of the stapler machine (portions cut-away)

Plunger head 38 as connected to blade 32 is caused to be moved in a controlled cyclical path by plunger head drive-control unit 50, which unit 50 is also pivotally operable about pin axle 19 on base 11. Drive-control unit 50 is supported on base 11 through spaced-apart parallel frame pieces 52, 53 (braced with top cross piece 55; FIG. 2) and through eccentric follower arms 56, 57 connected to frame pieces 14, 16, respectively using pivot pins 58. Eccentric follower arms 56, 57 include stem portions **56*a*, 57*a* and upper eccentric follower eyelet sections 56*b*, 57*b* which surround, follow and move relative to plastic discs 59, 61 which are eccentrically mounted on shaft 62 (see FIG. 5). Shaft 62 is secured to and turned by driven plastic gear-toothed wheel 63. Discs 59, 61, plastic shaft tube 60 and shaft 62 form a dumbbell unit 65 which unit is rotated by driven wheel 63 (see FIG. 5). The follower arms 56, 57 and the dumbbell unit 65 are positioned inside frame pieces 52, 53 to save space and to shorten the length of the shaft 62. With a shorter shaft 62, there is less torque applied that would, if not restrained, move shaft 62 up or down as viewed in FIG. I. Such torques include forces between driven wheel 63 and journals 62*a*, 62*b* in frame pieces 52, 53** as the forces which form and drive the staples are applied.

Shaft 62 is journaled for rotation in frame pieces 52, 53 and extends beyond frame piece 52 to carry driven plastic wheel 63 (see FIG. 2) which wheel 63 is in turn driven by spur gear 66 through motor shaft 67 of motor 68. Since shaft 62 is journaled in journals 62*a*, 62*b*, respectively in frame pieces 52, 53 which are pivotal about pin axle 19, shaft 62 moves in arc A (FIG. 1) which is also ascribed about pivot 19. Motor 68 is a 13,000 rpm DC 24 volt motor upon reduction generates 50 in/lbs. force to accomplish stapling. Motor 68 can be powered by batteries or by using a standard electrical outlet and a transformer.

Spur gears have one-tenth (1/10) the teeth of driven gear 63 thus providing a 10 to 1 reduction in speed and ten fold increase in torque. Driven gear 63 in turn transmits its torque through shaft 62 about a moment arm based on a distance equal to a portion of the diameter of plastic discs 59, 61. The motor rpm is reduced within the motor casing and by the spur gear 66 and driven wheel 63 to effect a rotary speed of shaft 62 of 150 rpm (or 2.5 revolutions per second).

Drive-control unit 50 includes a slot channel 71 comprising upper slide cross plate 72 which is preferably integrally formed with cross piece 55 and lower spaced-apart slide cross plates 73*a*, 73*b*. While both the stapler mechanism and the drive-control unit 50 pivot about axis 19, they have differing arcuate paths during their cyclical movement which requires sliding relative movement (1) between plunger button head 38 and upper cross plate 72 and (2) between pin 43 and lower spaced-apart cross plates 73*a*, 73*b*.

Figure 4:
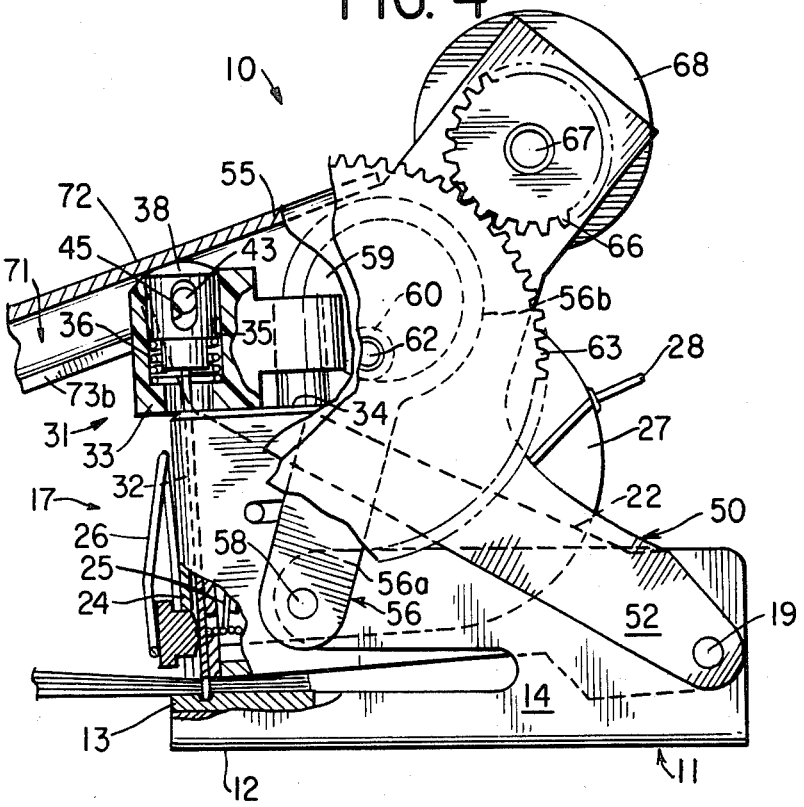
FIG. 4 is a right side elevational view of the stapler with the staple drive control in the downward setting position (portions cut-away)

Turning to FIG. 4, stapler 10 is shown in its down position as clinching of the stapler is accomplished. To reach the down position, slot channel 71 and its cross plate 72 have pushed down on plunger head 38 and have slid over the surface of head 38 such that slot channel 71 is well below the horizontal (up to 20 degrees or more below (see 0 angle FIG. 4). It is significant that slot channel 71 is generally in a horizontal position when stapler 10 is in its "up" position (FIG. 1) and that as stapler 10 moves down an angle is formed between the vertical axis of plunger head 38 and slot 71 which angle contributes to reducing friction. One of the reasons for reduction in friction is that head 38 slides over a longer distance on slot channel 71 because channel 71 moves substantially below horizontal. It is also seen that driven wheel shaft 62 has been moved to a downward position in which drive-control unit slot channel 71 has, in addition to sliding over head 38, forced head 38 and the stapler drive blade 32 (including intermediate linkage) down toward the bottom of its arcuate path A. As illustrated in FIG. 4, the workpiece has a thickness of about ten (10) sheets of paper and will thus require the compression of spring 36 (see FIG. 3) to permit the stapler upper drive unit 3 to reach its lowest point and thereafter start upwardly. Spring 36 is compressible to exert up to 40 lbs. force.

Figure 5:
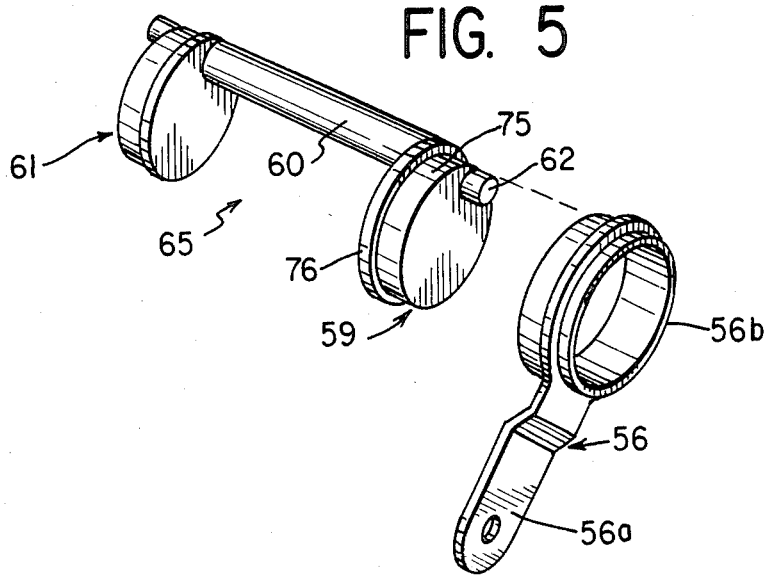
FIG. 5 is an exploded perspective view of portions of the dumbbell of the rotary drive unit and a follower arm.

FIG. 5 shows the dumbbell unit 65 consisting of a plastic axle tube 60 with circular stepped plastic discs 59, 61 integrally mounted off-center at each end. Each stepped disc 59, 61, has a bearing body section 75 and flange section 76. Shaft 62 is secured to driven wheel 63 and the journal tube 60 while it freely rotates in journal openings 62*a*, 62*b* in frame plates 52, 53. Thus, as the shaft 62 rotates dumbbell unit 65 rotates with shaft 62 to move driver-control unit 50 back and forth in an arcuate path A (FIGS. 1 and 4). Also shown in exploded view FIG. 5, is follower arm 56 having stem portion 56*a*, cylindrical eyepiece 56*b* for receiving the body portion of disc body section 75.

Figure 6:
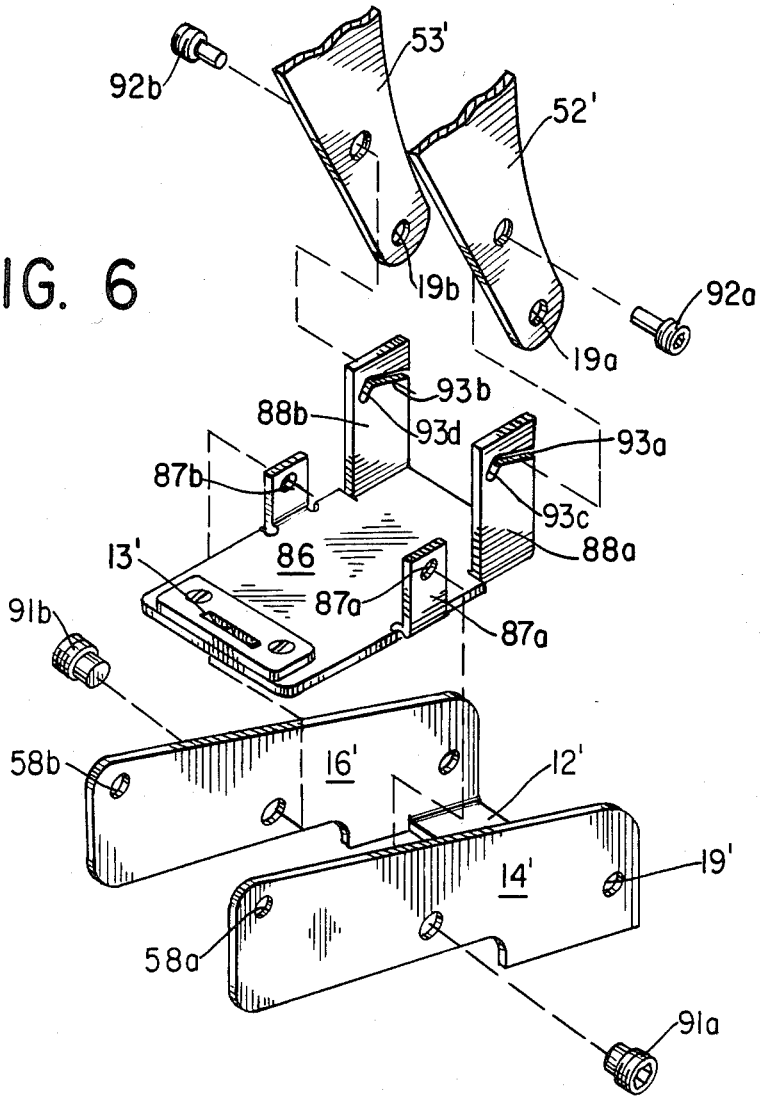
FIG. 6 is a perspective view showing an alternative embodiment with an anvil jaw unit and frame pieces.
Figure 7:
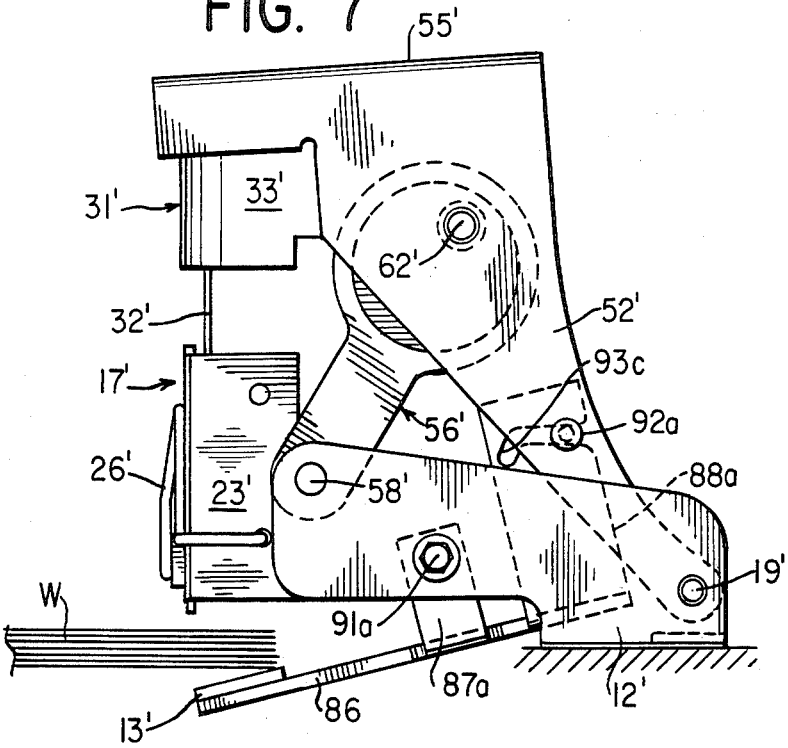
FIG. 7 is a side elevational view of the alternative embodiment with the anvil jaw open.
Figure 8:
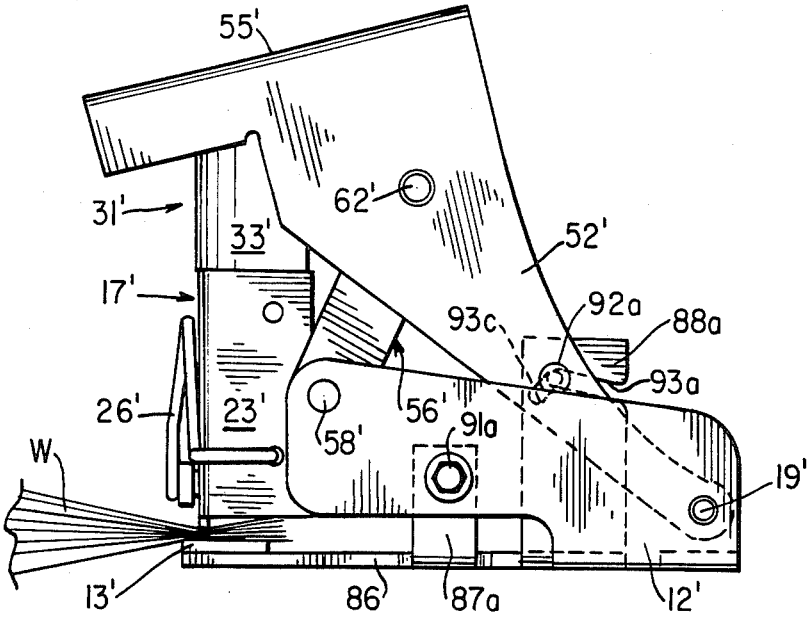
FIG. 8 is an alternatsive embodiment with the anvil jaw closed.

Finally, turning to FIGS. 6–8 showing an alternative embodiment in which the anvil is movable, pivotable anvil jaw unit 85 includes anvil base plate 86, a pair of plate pivot pieces 87*a*; 87*b*, plate cam uprights 88*a*, 88*b* and anvil 13'. Anvil unit 85 is pivotal about pivot axles 91*a*, 19*b* mounted on frame piece 14' and 16' respectively. The pivoting of anvil unit 85 is controlled by stud cams 92*a*, 92*b* affixed to the inner surfaces of control unit frame pieces 52', 53', respectively, which cams 92*a*, 92*b* travel in a reciprocating manner in grooves 93*a*, 93*b* in cam uprights 88*a*, 88*b* respectively. Grooves 93*a*, 93*b* are shaped to position anvil 13', in the proper location as frame pieces 52', 53', pivot back and forth about axis 19'. Grooves 93*a*, 93*b* have open ends for ease of assembly. The opening of anvil jaw unit 85 facilitates entry of workpiece W' between anvil 13' and the stapler head section 23'. The closing of jaw unit 85 places anvil 13' in the proper position for clinching and stapling as the stapler 10' moves through a cycle.

Turning to FIGS. 7 and 8, it is seen that this alternative second embodiment is constructed similar to the first embodiment described above with reference to FIGS. 1–5 and that as shaft 62 moves through its cycle frame pieces 52' (53') move cams 92*a* (92*b*) through grooves 93*a* (93*b*) to pivot the anvil jaw unit 85 about 91*a* (91*b*). In FIG. 7, jaw unit 85 is open to receive workpiece W' and in FIG. 8 it is closed to clinch the workpiece. Since grooves 93*a* (93*b*) have groove sections 93*c* (93*d*) oriented on an angle crossing an arc about axis 19', as frame pieces 52' (53') move further downward during the stapling stroke cams 92*a* (92*b*) move downwardly in groove sections 93*c* (93*d*) locking the anvil plate 86 in place. Further movement downward of frame pieces 52' (53') accomplishes stapling without further movemnet of anvil 13'.

In the operation of the stapler machine, the stapler mechanism 17 is raised to its upper position (FIG. 1) as cross plates 73*a*, 73*b* lift pin 43, the workpiece, for example two (2) sheets of paper, is placed on the anvil 13 and motor 68 is energized through a suitable switch (not shown). Since the stapler mechanism 17 is raised to the upper position no return spring is required. Since no return spring is required the force to overcome a return spring is not required during driving of the fastener. As motor 68 is energized and starts up it draws relatively small current since there is only a small frictional load in the system and even the maximum forces required for forming and driving the staple required during subsequent portions of the cycle are relatively small since forces are applied over a sufficient length of time to reduce peak power demands. Three (3) small rechargeable dry-cell 9 volt batteries in series provide adequate power. Motor 68 turns motor shaft and spur gear 66 to rotate driven gear 63. Rotation of the driven gear 63 causes rotation of the shaft 62 journaled in journals 62*a*, 62*b* in spaced-apart pivotal frame pieces 52, 53. As shaft 62 rotates dumbbell unit 65 (of which circular plastic disc 59, 61 are a part; see FIG. 5) also rotates. Follower arm cylindrical eyepieces 56*b*, 57*b* accommodate shaft 62 movement in a reciprocating arcuate manner along arc A carrying with it frame pieces 52, 53 (and, as demanded, transmitting forces) to such frame pieces 52, 53. Thus as pivotal frame pieces 52, 53 move together in an arcuate cyclic path the entire drive-control unit 50

(including its slot channel 72) follow in similar movement as one integral structure. Slot channel 72 has frictional cross plate 72 which applies sliding forces to plunger button head 38 and attached driver blade 32 to move them downwardly to form and drive staples into the workpiece. In the alternative embodiment, the anvil 13' moves open and closes during the operative cycle.

Since there is a zero clearance between (1 the top of plunger button 38 and (2) the upper surface to a stack of two (2) sheets on anvil 13 in the lowest position of its cycle of movement, spring 36 will not compress. If more than two (2) sheets are stapled (such as ten (10) sheets) spring 36 will, of necessity, be compressed a distance equal to the thickness of an additional eight (8) sheets (as the sheets are compressed) to prevent jamming or straining of the machine. The depth of slot 45 permits pin 43 to raise as blade 32 encounters additional forces of resistance due to the thickness of the workpiece W.

As the pivotal stapler mechanism 17 reaches its upward position above anvil 13, a switch (not shown) is opened to de-energize motor 68. The stapler 10 is now ready for subsequent stapling operations.

The simplicity and compactness of the power train (motor, transmission and eccentric dumbbell arrangement) requires reduced peak motor power than prior motor powered staplers. The present invention requires only two (2) torque transmitting shafts —(a) the motor shaft 67 carrying the spur gear 66 and (b) the driven wheel shaft 62. This reduces bearing and other friction as compared with more complicated multishaft prior art devices. Further, shaft journals **62*a*, 62*b* of frame pieces 52, 53 (against which the forces are applied to cause drive-control unit 50** to forcefully form and drive staples), are spaced as close together as the width of the stapler mechanism permits thus reducing loss of power due to extraneous torques.

The fastening mechanism disclosed in U.S. Pat. No. 4,542,844 operates with a fixed stapler head in which former 70 is caused to be moved below staple head 30 down to and against the workpiece on anvil 23. While the same basic stapler mechanism may be employed as part of the present stapler 10, modification of the travel of former 70 is required since the present stapler head 23 is pivoted about pivot 19 making unnecessary and undesirable movement of former 70 out of stapler head 23. The preferable modification is a redesign of elements 48 of the mechanism of such prior patent to prevent pusher elements 84 from frictionally engaging surfaces 79.

I claim:

1. In a motor-driven fastener machine having a base, an anvil on the base, a fastener driving mechanism mounted for movement relative to the base, the improving comprising drive-control means also mounted on the base about pivot means for movement with respect to the base to cause the fastener driving mechanism to drive the fastener against the anvil;

rotary drive means mounted on the drive-control means such rotary drive means including eccentric means carrying shaft means;

follower arm means mounted between (1) the base about a second pivot means spaced from the first pivot means, and (2) the rotary drive means such arm means including eyelet means for surrounding and engaging the eccentric means;

transmission means (66,63) connected to the rotary drive means (68) for causing the drive-control means (50) carrying such shaft means (62) to move through a cycle of movement including a reciprocating path (A); and fastener mechanism means (55) on the drive-control means (50) slidably engageable with the fastener driving mechanism (17, 43) which engagement means (55) causes at times the fastener mechanism (I7, 43) to be driven downwardly and at other times causes the drive-control means to move the fastener mechanism upwardly.

2. The fastener machine of claim 1 in which the rotary drive means includes a driven wheel and having in addition dumbbell means comprising in turn (1) such means secured to the driven wheel and (2) two spaced apart cylindrical elements secured in an offset manner to the shaft means and further having follower arm dumbbell engaging means which is a circular recessed opening for receiving one of the cylindrical elements whereby rotation of the driven wheel carries the circular elements around such shaft in an eccentric pattern.

3. The fastener machine of claim 1 in which the fastener driving mechanism includes a head workpiece compensation means which includes spring means which is compressible between the workpiece and the engagement means on the driving and control means.

4. The stapler machine of claim 1 in which the transmission means comprises a motor-driven shaft and spur gear which spur gear is engageable with the driven wheel and shaft means.

5. The motor-driven fastener machine of claim 1 in which the anvil is in turn mounted on an anvil plate means which plate means is pivotally mounted on the base for pivoting from an open to a close position and having further first cam means on the anvil late means and cooperating second cam means on the driving and control means to cause such plate means to pivot.

6. In a motor-driven staple machine having a base, an anvil on the base, a staple forming and driving mechanism pivotal on the base, the improvement comprising drive-control unit means mounted on the base about a first pivot means for causing the stapler forming and driving mechanism to form and drive the stapler against the anvil;

rotary drive means mounted on the drive-control unit means such rotary drive means including dumbbell means carrying shaft means mounted on the drive-control unit means;

follower arm means mounted between (1) the base about a second pivot means spaced from the first pivot means, and (2) the rotary drive means, such arm means including dumbbell engaging means;

transmission means connected to the rotary drive means for causing the drive-control unit means to carry such shaft means to move pivotally through a cycle of movement including a reciprocating arcuate path; and slot channel means on the drive-control unit means slidably engageable with the staple mechanism which slot channel means causes at times the staple mechanism to drive the stapler mechanism downwardly and further at other times causes the driving and control means to move the staple mechanism upwardly.

7. The staple mechanism of claim 6 in which the rotary drive means includes a driven wheel and having in addition a dumbbell unit comprising in turn (1) shaft means secured to the wheel and (2) two spaced apart cylindrical elements secured in an offset manner to the shaft means and in which the follower arm dumbbell carrying means is a circular recessed opening for receiving one of the circular elements whereby rotation of the driven wheel carries the cylindrical elements around such shaft in an eccentric pattern.

8. The stapler machine of claim 6 in which the stapler driving mechanism includes a head workpiece compensation means which includes spring means which is compressible between the workpiece and the slot means on the drive-control unit.

9. The stapler machine of claim 6 having battery means for powering the motor driven shaft.

10. The stapler machine of claim 6 in which slot channel means is substantially horizontal in its upper position and below horizontal in its down position.

* * * * *

UNITED STATES PATENT AND TRADEMARK OFFICE

CERTIFICATE OF CORRECTION

PATENT NO. : 4,720,033

DATED : January 19, 1988

INVENTOR(S) : Paul Olesen

It is certified that error appears in the above-identified patent and that said Letters Patent is hereby corrected as shown below:

Column 2, line 18, "alternatsive" should read --alternative--.

Column 3, line 17, "ten fold" should read --tenfold--.

Column 5, lines 53-54, "improving" should read --improvement--.

Column 6, line 4, "mechanism means" should read --mechanism engagement means--;

line 34, "anvil late" should read --anvil plate--.

Signed and Sealed this

Twenty-third Day of August, 1988

*Attest:*

DONALD J. QUIGG

*Attesting Officer*

*Commissioner of Patents and Trademarks*